US010506827B2

(12) United States Patent
Guo et al.

(10) Patent No.: US 10,506,827 B2
(45) Date of Patent: Dec. 17, 2019

(54) ULTRASONIC AUTOMIZATION PIECE, MANUFACTURING METHOD THEREOF, ULTRASONIC AUTOMIZER AND ELECTRONIC CIGARETTE

(71) Applicant: CHINA TOBACCO HUNAN INDUSTRIAL CO., LTD., Changsha, Hunan (CN)

(72) Inventors: Xiaoyi Guo, Hunan (CN); Yuangang Dai, Hunan (CN); Xinqiang Yin, Hunan (CN); Wei Huang, Hunan (CN); Hong Yu, Hunan (CN); Jianhua Yi, Hunan (CN); Kejun Zhong, Hunan (CN); Jianfu Liu, Hunan (CN); Yongquan Zhou, Hunan (CN)

(73) Assignee: CHINA TOBACCO HUNAN INDUSTRIAL CO., LTD., Changsha, Hunan (CN)

( * ) Notice: Subject to any disclaimer, the term of this patent is extended or adjusted under 35 U.S.C. 154(b) by 174 days.

(21) Appl. No.: 15/578,540

(22) PCT Filed: Sep. 7, 2016

(86) PCT No.: PCT/CN2016/098287
§ 371 (c)(1),
(2) Date: Nov. 30, 2017

(87) PCT Pub. No.: WO2018/032553
PCT Pub. Date: Feb. 22, 2018

(65) Prior Publication Data

US 2018/0325169 A1 Nov. 15, 2018

(30) Foreign Application Priority Data

Aug. 19, 2016 (CN) ..... 2016 1 0697917

(51) Int. Cl.
*A24F 13/00* (2006.01)
*A24F 17/00* (2006.01)
(Continued)

(52) U.S. Cl.
CPC ..... *A24F 47/002* (2013.01); *A24F 47/008* (2013.01); *B05B 17/06* (2013.01);
(Continued)

(58) Field of Classification Search
CPC ..... A24F 47/002; A24F 47/008; B05B 17/06
(Continued)

(56) References Cited

U.S. PATENT DOCUMENTS 4,530,464 A * 7/1985 Yamamoto ..... B05B 17/0646 228/124.1
7,954,730 B2 * 6/2011 Ng ..... B05B 17/0646 239/102.1
(Continued)

FOREIGN PATENT DOCUMENTS

CN 100381082 C 4/2008
CN 100381083 C 4/2008
(Continued)

OTHER PUBLICATIONS

International Search Report issued in International Application No. PCT/CN2016/098287 dated Mar. 30, 2017, 5 pages.

*Primary Examiner* — Hae Moon Hyeon
(74) *Attorney, Agent, or Firm* — Mauriel Kapouytian Woods LLP; James Woods

(57) ABSTRACT

Embodiments of the present invention disclose an ultrasonic atomization piece, a manufacturing method thereof, an ultrasonic atomizer and electronic cigarette. The ultrasonic atomization piece comprises a ceramic substrate, which is provided with an upper silver layer on the upper surface and with a lower silver layer on the lower surface. The ceramic
(Continued)

substrate, the upper silver layer and the lower silver layer form piezoelectric ceramic, and glass glaze for protecting the upper silver layer is provided on the upper surface of the piezoelectric ceramic; and a tobacco tar adsorption layer is provided on the upper surface of the glass glaze to form a piezoelectric ceramic component, and the tobacco tar adsorption layer is used for adsorbing, guiding and transferring tobacco tar.

18 Claims, 5 Drawing Sheets

(51) Int. Cl.

| | |
|---|---|
| ***A24F 25/00*** | (2006.01) |
| ***A24F 47/00*** | (2006.01) |
| ***B05B 17/06*** | (2006.01) |
| ***B06B 1/06*** | (2006.01) |
| *B05B 7/00* | (2006.01) |

(52) U.S. Cl.
CPC ..... *B06B 1/0651* (2013.01); *B05B 7/0012* (2013.01); *B05B 17/0615* (2013.01); *B06B 2201/55* (2013.01)

(58) Field of Classification Search
USPC ..... 131/328, 329
See application file for complete search history.

(56) References Cited

U.S. PATENT DOCUMENTS

| | | | | |
|---|---|---|---|---|
| 2016/0213866 | A1 | 7/2016 | Tan | |
| 2018/0007967 | A1* | 1/2018 | Davis | A24F 47/008 |
| 2018/0161525 | A1* | 6/2018 | Liu | A61M 15/001 |
| 2018/0242644 | A1* | 8/2018 | Bessant | H05B 1/0227 |
| 2019/0142063 | A1* | 5/2019 | Liu | A24F 47/00 |

FOREIGN PATENT DOCUMENTS

| | | | |
|---|---|---|---|
| CN | 105433443 | A | 3/2016 |
| CN | 205106385 | U | 3/2016 |
| CN | 105559151 | A | 5/2016 |
| CN | 205250357 | U | 5/2016 |
| CN | 105725281 | A | 7/2016 |
| CN | 105768238 | A | 7/2016 |

* cited by examiner

ULTRASONIC AUTOMIZATION PIECE, MANUFACTURING METHOD THEREOF, ULTRASONIC AUTOMIZER AND ELECTRONIC CIGARETTE

CROSS REFERENCE TO RELATED APPLICATIONS

This application is a national phase application of international application number PCT/CN2016/098287 filed on Sep. 7, 2016, which claims priority to Chinese application number 2016106979170 filed on Aug. 19, 2016. The entire contents of these applications are hereby incorporated herein by reference.

FIELD OF THE INVENTION

The present invention relates to an ultrasonic atomization piece, a manufacturing method thereof, an ultrasonic atomizer and electronic cigarette, and the present invention belongs to the field of electronic cigarette.

BACKGROUND OF THE INVENTION

At present, ultrasonic atomization pieces on the market include low-frequency ultrasonic atomization pieces with micropores penetrating through the entire atomization pieces and high-frequency ultrasonic atomization pieces without micropores, but all the ultrasonic atomization pieces lack tobacco tar adsorption layers which has the function of tobacco tar adsorption, resulting in poor contact between the ultrasonic atomization pieces and tobacco tar guide structures, such that tobacco tar leakage is produced easily or the working lives of the ultrasonic atomization pieces are shortened, and the structures of the electronic cigarette formed by assembly is relatively complex.

The shortcomings of the prior art are as follows:

1. The ultrasonic atomization pieces are separated from the tobacco tar guide structures, resulting in poor contact of the tobacco tar easily, which leads to the problems of poor atomization effects and short working lives.

2. As the ultrasonic atomization pieces are separated from the tobacco tar guide structures, the assembly process is complex.

BRIEF SUMMARY OF THE INVENTION

The present invention aims at providing an ultrasonic atomization piece, a manufacturing method thereof, an ultrasonic atomizer and an electronic cigarette. In the ultrasonic atomization piece, as a tobacco tar adsorption layer and an ultrasonic atomization piece body are integrated together, the contact between the ultrasonic atomization piece and tobacco tar is better in the assembly process of the electronic cigarette, and the assembly is simpler and more convenient. Since the tobacco tar adsorption layer is fixed to a specified position of the ultrasonic atomization piece body, the tobacco tar adsorption layer will not drop or incline during the assembly process and the working process of the ultrasonic atomization piece, and thus its atomization effect is improved.

To achieve the above objective, the present invention adopts the technical solutions as follows:

An ultrasonic atomization piece, its structural features are as follows: the ultrasonic atomization piece comprises a ceramic substrate, which is provided with an upper silver layer on the upper surface and a lower silver layer on the lower surface; the ceramic substrate, the upper silver layer and the lower silver layer form piezoelectric ceramic, and glass glaze layer for protecting the upper silver layer is provided on the upper surface of the piezoelectric ceramic; and a tobacco tar adsorption layer is provided on the upper surface of the glass glaze layer to form a piezoelectric ceramic component; and the tobacco tar adsorption layer is used for adsorbing, guiding and transferring tobacco tar.

According to embodiments of the present invention, the present invention can also be further optimized to form the following technical solutions after optimization:

According to a first preferred embodiment of the present invention, the tobacco tar adsorption layer is a ceramic slurry layer.

According to a second preferred embodiment of the present invention, the tobacco tar adsorption layer is a porous material layer. In order to improve the effect of the tobacco tar adsorption, the upper surface of the glass glaze layer is formed into a concavo-convex surface, and the porous material layer is fixed to the concavo-convex surface. Further, the concavo-convex surface and the porous material layer are adhered together by high-temperature glue.

Preferably, the thickness of the porous material layer is 0.1-0.5 mm.

The porous material layer is cotton or non-woven fabric.

Based on the same inventive conception, the present invention further provides a manufacturing method of the ultrasonic atomization piece, comprising the following steps:

S1, spraying or printing the upper silver layer on the upper surface of the ceramic substrate, and spraying or printing the lower silver layer on the lower surface of the ceramic substrate to form the piezoelectric ceramic;

S2, spraying or printing a glass glaze layer on the surface of the upper silver layer of the piezoelectric ceramic;

S3, spraying or printing the ceramic slurry layer serving as the tobacco tar adsorption layer on the surface of the glass glaze layer of the piezoelectric ceramic to obtain a primary green body of the piezoelectric ceramic component; and S4, heating, sintering and solidifying the primary green body of the piezoelectric ceramic component, and cooling the same to obtain a finished product of the piezoelectric ceramic component.

Preferably, the sintering and solidifying temperature of the primary green body of the piezoelectric ceramic component is 600-900° C. the sintering time is 2-18 h, and preferably, the sintering time is 10-14 h.

Preferably, after being heated, sintered and solidified, the primary green body of the piezoelectric ceramic component is cooled in a cooling device for 8-25 h to obtain the finished product, and preferably, the cooling time is 12-15 h.

Based on the same inventive conception, the present invention further provides a manufacturing method of the ultrasonic atomization piece, comprising the following steps:

S1 spraying or printing the upper silver layer on the upper surface of the ceramic substrate, and spraying or printing the lower silver layer on the lower surface of the ceramic substrate to form the piezoelectric ceramic;

S2, spraying or printing a glass glaze layer on the surface of the upper silver layer of the piezoelectric ceramic;

S3, grinding the surface of the glass glaze layer of the piezoelectric ceramic to form a concavo-convex surface, and then fixing a porous material layer serving as the tobacco tar adsorption layer on the concavo-convex surface of the glass glaze layer to obtain a primary green body of the piezoelectric ceramic component; and S4, drying and solidifying the primary green body of the piezoelectric ceramic component to obtain a finished product of the piezoelectric ceramic component.

High-temperature glue is coated on the concavo-convex surface of the glass glaze layer, then the porous material layer is adhered on the concavo-convex surface of the glass glaze layer, and finally drying and solidifying treatments are carried out.

Based on the same inventive conception, the present invention further provides an ultrasonic atomizer, comprising an outer sleeve with a suction nozzle, a tobacco tar guide component fixed to the lower end of the outer sleeve, and an atomization core fixed to the lower end of the tobacco tar guide component. The structural features of the ultrasonic atomizer are as follows: the ultrasonic atomization piece is installed in the atomization core, and the tobacco tar adsorption layer of the ultrasonic atomization piece is in contact with the tobacco tar guide component.

According to the embodiments of the present invention, a tobacco tar bin is provided in the outer sleeve, a tobacco tar guide structure for communicating the tobacco tar bin with the tobacco tar adsorption layer is provided in the tobacco tar guide component, so that the tobacco tar in the tobacco tar bin is transferred to the tobacco tar adsorption layer by the tobacco tar guide structure, and then after the tobacco tar is atomized into tobacco tar smoke by ultrasonic atomization, the tobacco tar smoke flows to the suction nozzle.

To conveniently detach and replace the tobacco tar guide component, the outer sleeve is in detachable connection with the tobacco tar guide component, and the tobacco tar guide component is in detachable connection with the atomization core, so that the use cost can be reduced, and better sanitation is realized.

Preferably, the tobacco tar guide component comprises:

a connector connected with the outer sleeve, and a sealing ring is provided between the connector and the outer sleeve; and a fixing base, a silica gel seat installed in the fixing base, and tobacco tar guide cotton located in the silica gel base; and a vent hole or a vent groove is provided in the side wall of the fixing base.

Preferably, the atomization core comprises:

a base, a silica gel sleeve installed in the base;

an inner electrode installed at the lower end of the base through an insulation ring; and a piezoelectric ceramic component serving as the ultrasonic atomization piece, the piezoelectric ceramic component is provided in the silica gel sleeve, and the lower surface of the piezoelectric ceramic component is in electric connection with the top end of the inner electrode.

Based on the same inventive conception, the utility model further provides an electronic cigarette, comprising the ultrasonic atomizer.

By means of the above structures, in the present invention, the tobacco tar adsorption layer is provided on the surface of the ultrasonic atomization piece, and the tobacco tar adsorption layer and the ultrasonic atomization piece body are integrated together, therefore the contact between the ultrasonic atomization piece and tobacco tar is better in the assembly process of the electronic cigarette, and the assembly is simpler and more convenient. Since the tobacco tar adsorption layer is fixed to the specified position of the ultrasonic atomization piece body, the tobacco tar adsorption layer will not drop or incline during the assembly process and the working process of the ultrasonic atomization piece, and thus its atomization effect can be improved. Meanwhile, the tobacco tar adsorption layer and the ultrasonic atomization piece body can also be integrated together by a package process, a etching process or other processing technologies, thereby being free of delamination and prolonging the working life of the atomization piece.

Compared with the prior art, the present invention has the following beneficial effects:

1. The tobacco tar adsorption layer and the ultrasonic atomization piece are integrated together to facilitate assembly and prevent poor contact between the ultrasonic atomization piece and the tobacco tar to affect the atomization effect, namely no tobacco tar smoke or little tobacco tar smoke is generated, as a result, the amount of tobacco tar smoke in each smoking is different, which affects the user experience; and the working life of the ultrasonic atomization piece can also be prolonged.

2. As the tobacco tar adsorption layer and the ultrasonic atomization piece are integrated together, the process is simple and the atomization effect is good.

BRIEF DESCRIPTION OF THE SEVERAL VIEWS OF THE DRAWING(S)

In the above figures,

1. suction nozzle; 2. outer sleeve; 3. tobacco tar guide component; 4. atomization core; 5. connector; 6. sealing ring; 7. silica gel base; 8. fixing base; 81. a vent hole or a vent groove; 9. tobacco tar guide cotton; 10. piezoelectric ceramic component; 11. silica gel sleeve; 12. base; 13. insulation ring; 14. inner electrode; 101. porous material layer; 102. glass glaze layer; 103. upper silver layer; 104. ceramic substrate; 105. lower silver layer; 106. piezoelectric ceramic; 107. ceramic slurry layer; 108. concavo-convex surface; 109. heating device; 110. cooling device.

DETAILED DESCRIPTION OF THE INVENTION

Hereinafter, the present invention will be described in detail with reference to the drawings in combination with embodiments. It should be noted that the embodiments in the present invention and the features in the embodiments can be combined with each other without conflict. For the sake of convenience, the words "up", "down", "left" and "right" herein below only express consistency with the upper, lower, left and right directions of the drawings, and do not constitute limitation to the structure.

Embodiment 1

Figure 5:
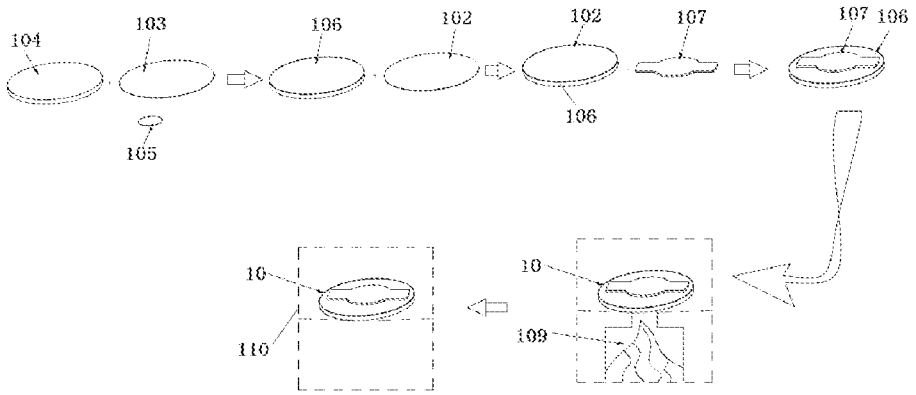
FIG. 5 is a manufacturing flow chart of an ultrasonic atomization piece of the present invention.

An ultrasonic atomization piece, as shown in FIG. 5, comprises a ceramic substrate 104 which is provided with an upper silver layer 103 on the upper surface and a lower silver layer 105 on the lower surface; the ceramic substrate 104, the upper silver layer 103 and the lower silver layer 105 form piezoelectric ceramic 106, and glass glaze layer 102 for protecting the upper silver layer 103 is provided on the upper surface of the piezoelectric ceramic 106; and a tobacco tar adsorption layer is provided on the upper surface of the glass glaze layer 102 to form a piezoelectric ceramic component 10, the tobacco tar adsorption layer is a ceramic slurry layer 107, and the tobacco tar adsorption layer is used for adsorbing, guiding and transferring tobacco tar.

As shown in FIG. 5, a sintering manufacturing process flow of the piezoelectric ceramic component comprises the following steps:

1. Spraying the upper silver layer and lower silver layer on the upper surface and lower surface of the ceramic substrate to obtain the piezoelectric ceramic.

2. Spraying a glass glaze layer on the surface of the upper silver layer of the piezoelectric ceramic, the glass glaze layer is mainly used for protecting the upper silver layer, as the glass glaze layer with acid and alkali resistance and other properties is in direct contact with liquid.

3. Spraying the ceramic slurry layer in various shapes on the surface of the glass glaze layer of the piezoelectric ceramic, the ceramic slurry layer is mainly used for adsorbing tobacco tar or guiding and transferring the tobacco tar, because the ceramic itself has porosity and tobacco tar guide property.

4. Obtaining a primary green body of the piezoelectric ceramic component.

5. Placing the primary green body of the piezoelectric ceramic component in a furnace and sintering it at a high temperature of 600-900° C. for 10-14 h.

6. Cooling the sintered piezoelectric ceramic component by a cooling device for 12-15 h to obtain a finished product.

In summary, the sintering manufacturing method of the ultrasonic atomization piece in the embodiment is as follows: spraying or printing ceramic slurry on the glass glaze layer of the piezoelectric ceramic atomization piece, and then integrating the ceramic slurry and the glass glaze layer by the sintering process, which is conducive to improve the tobacco tar guide property, the atomization effect and the working life of the ultrasonic atomization piece. Meanwhile, the structure of an electronic cigarette product is simplified, and the electronic cigarette product is simple and convenient to assemble.

Embodiment 2

Figure 6:
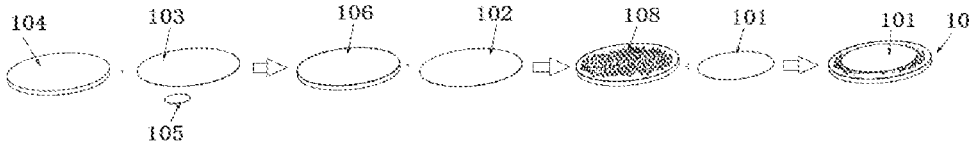
FIG. 6 is another manufacturing flow chart of an ultrasonic atomization piece of the present invention.

As shown in FIG. 6, an ultrasonic atomization piece in Embodiment 2 has similar structure with that in the embodiment 1, the differences between them are as follows: the upper surface of the glass glaze layer 102 is formed into a concavo-convex surface 108, and the porous material layer 101 serving as the tobacco tar adsorption layer is fixed to the concavo-convex surface 108, the porous material layer 101 is preferably cotton or non-woven fabric, and the concavo-convex surface 108 and the porous material layer 101 are adhered together by high-temperature glue. The thickness of the porous material layer 101 is 0.1-0.5 mm.

The flow of manufacturing piezoelectric ceramic by an adhesion process comprises the following steps:

1. Spraying the upper silver layer and lower silver layer on the upper surface and the lower surface of the ceramic substrate to obtain the piezoelectric ceramic.

2. Spraying a glass glaze layer on the surface of the upper silver layer of the piezoelectric ceramic, the glass glaze layer is mainly used for protecting the upper silver layer, as the glass glaze layer with acid and alkali resistance and other properties is in direct contact with liquid.

3. Grinding the surface of the glass glaze layer of the piezoelectric ceramic, then coating the high-temperature glue on the surface, finally adhering the porous material to the surface of the glass glaze layer to form piezoelectric ceramic capable of guiding tobacco tar, wherein the glass glaze layer is grinded to form a concavo-convex surface, and then coating a layer of high-temperature glue; the porous material is cotton, non-woven fabric or the like; preferably, the thickness of the porous material layer is 0.1-0.5 mm.

4. Drying the piezoelectric ceramic in a drying machine to obtain a finished product of the piezoelectric ceramic which has function of tobacco tar guide.

To sum up, the method for manufacturing the ultrasonic atomization piece by using an adhesion method in the embodiment is as follows: grinding the glass glaze layer of the piezoelectric ceramic atomization piece, spraying the high-temperature glue to the grinded area, and adhering the tobacco tar guide cotton and other porous materials thereon to form an entirety, which is conducive to improve the performance of the tobacco tar guide, the atomization effect and the working life of the ultrasonic atomization piece. Meanwhile, the structure of an electronic cigarette product is simplified, and the electronic cigarette product is simple and convenient to assemble. The used high-temperature glue comprises strong universal glue, nylon adherent, AB adherent, etc.

Embodiment 3

Figure 1:
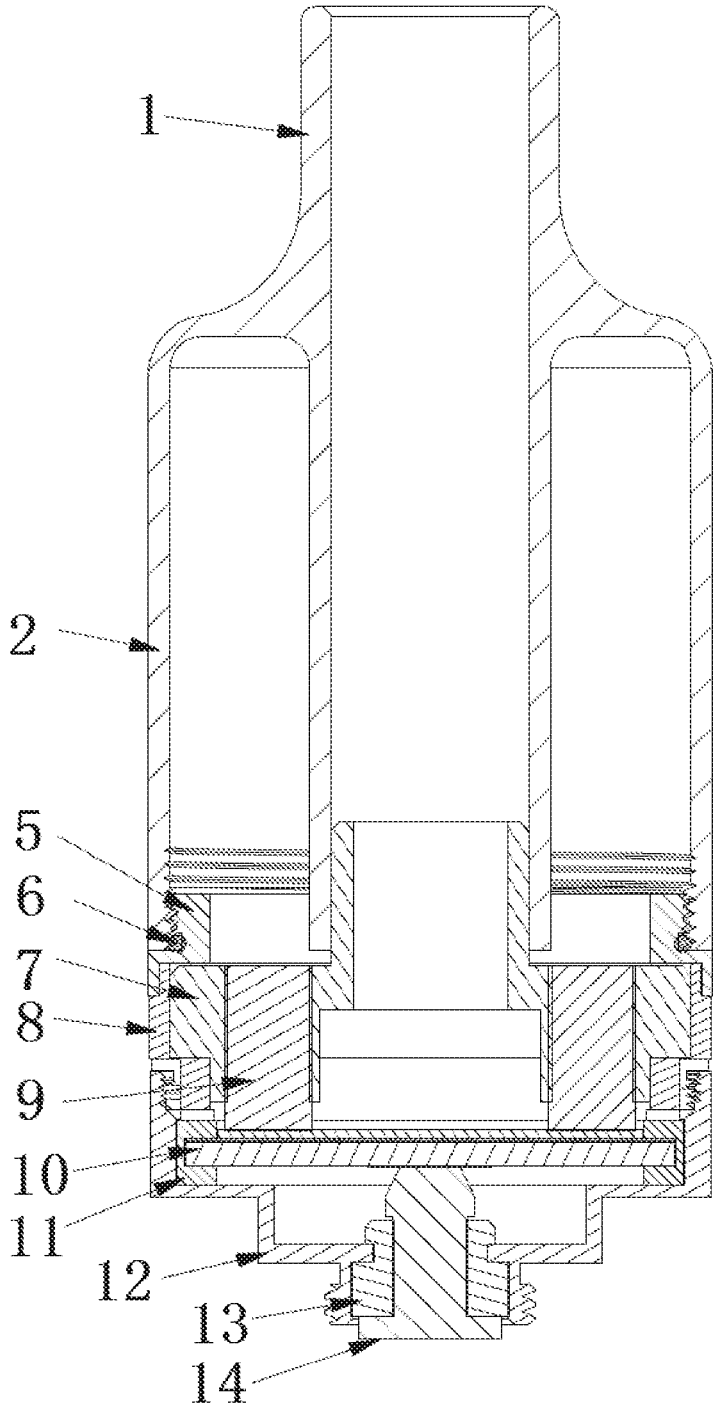
FIG. 1 is a schematic diagram of a longitudinal section structure of an embodiment of the present invention.
Figure 2:
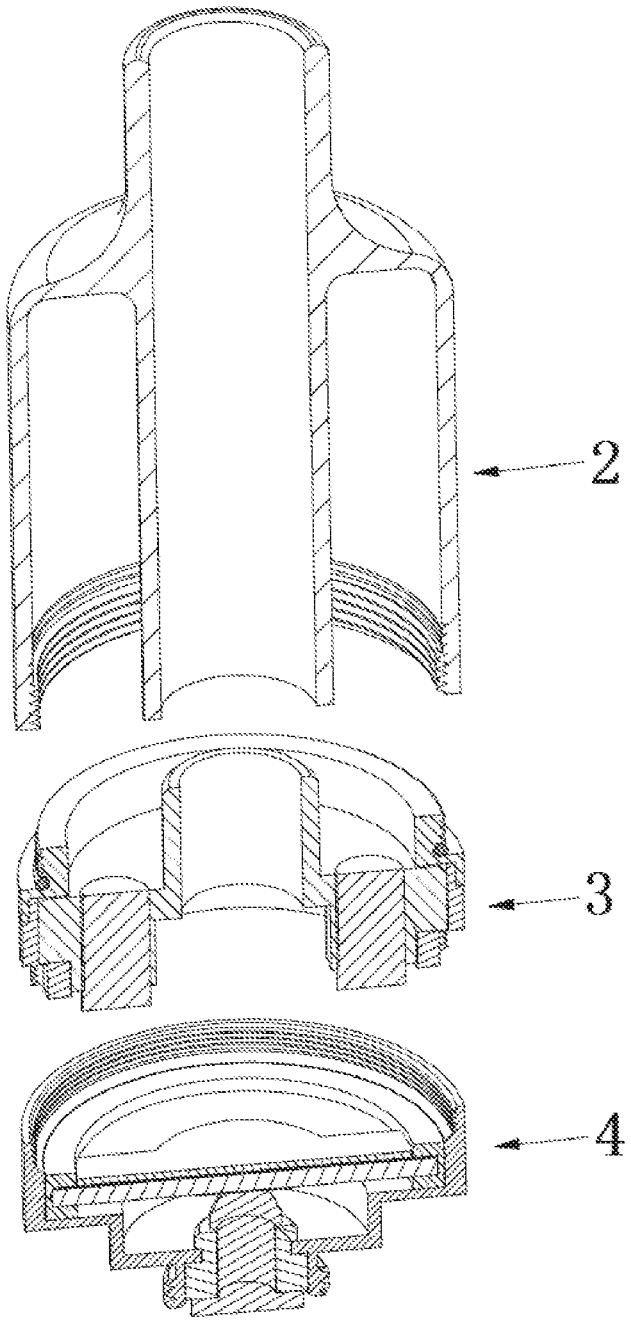
FIG. 2 is a split schematic diagram of FIG. 1.
Figure 4:
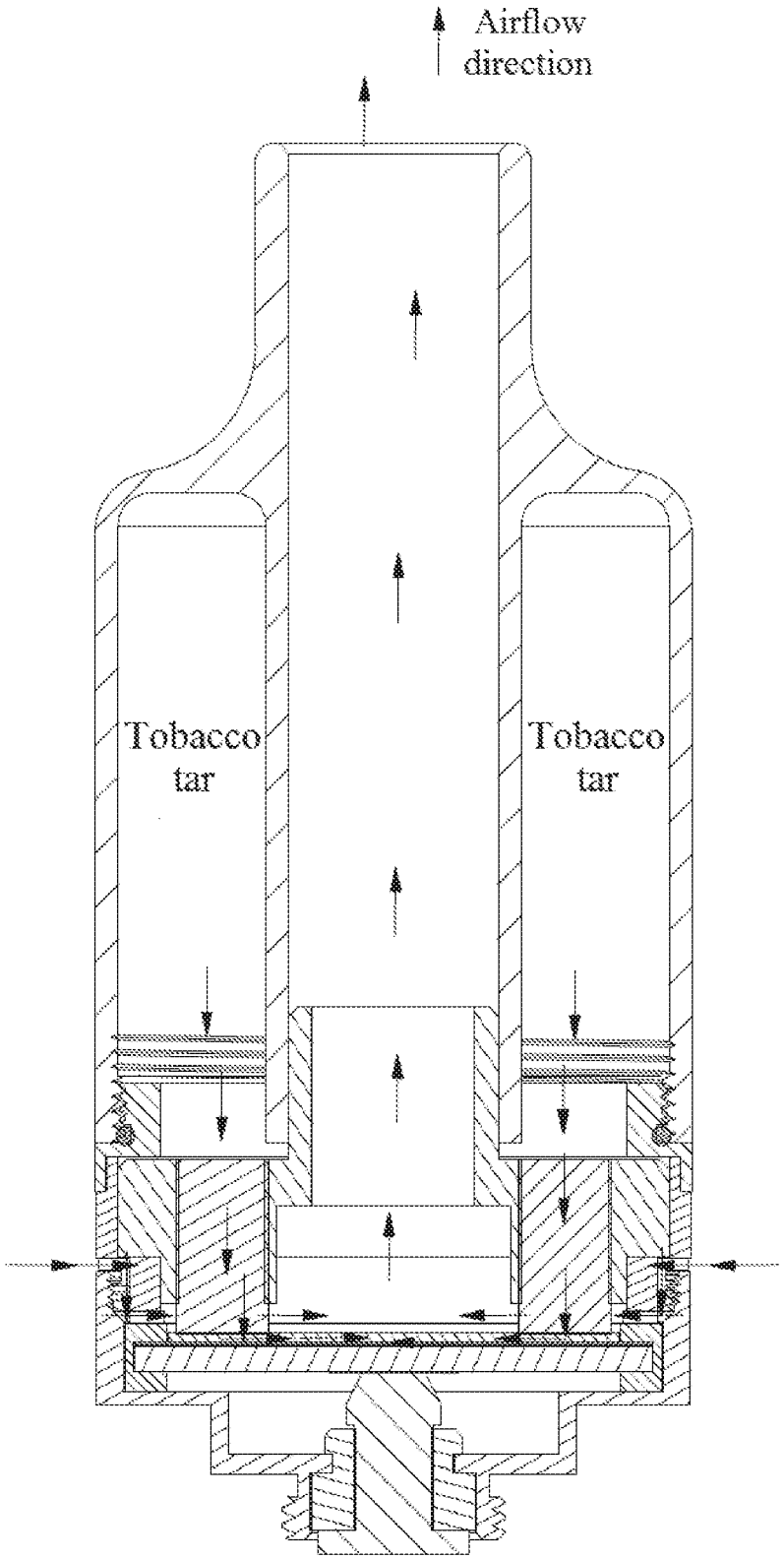
FIG. 4 is a schematic diagram of operation of tobacco tar airflow in FIG. 1.

As shown in FIG. 1, FIG. 2 and FIG. 4, an ultrasonic atomizer, comprising an outer sleeve 2 with a suction nozzle 1, a tobacco tar guide component 3 fixed to the lower end of the outer sleeve 2 and an atomization core 4 fixed to the lower end of the tobacco tar guide component 3. The ultrasonic atomizer is structurally characterized in that the ultrasonic atomization piece is installed in the atomization core 4, and the tobacco tar adsorption layer of the ultrasonic atomization piece is in contact with the tobacco tar guide component 3.

Figure 3:
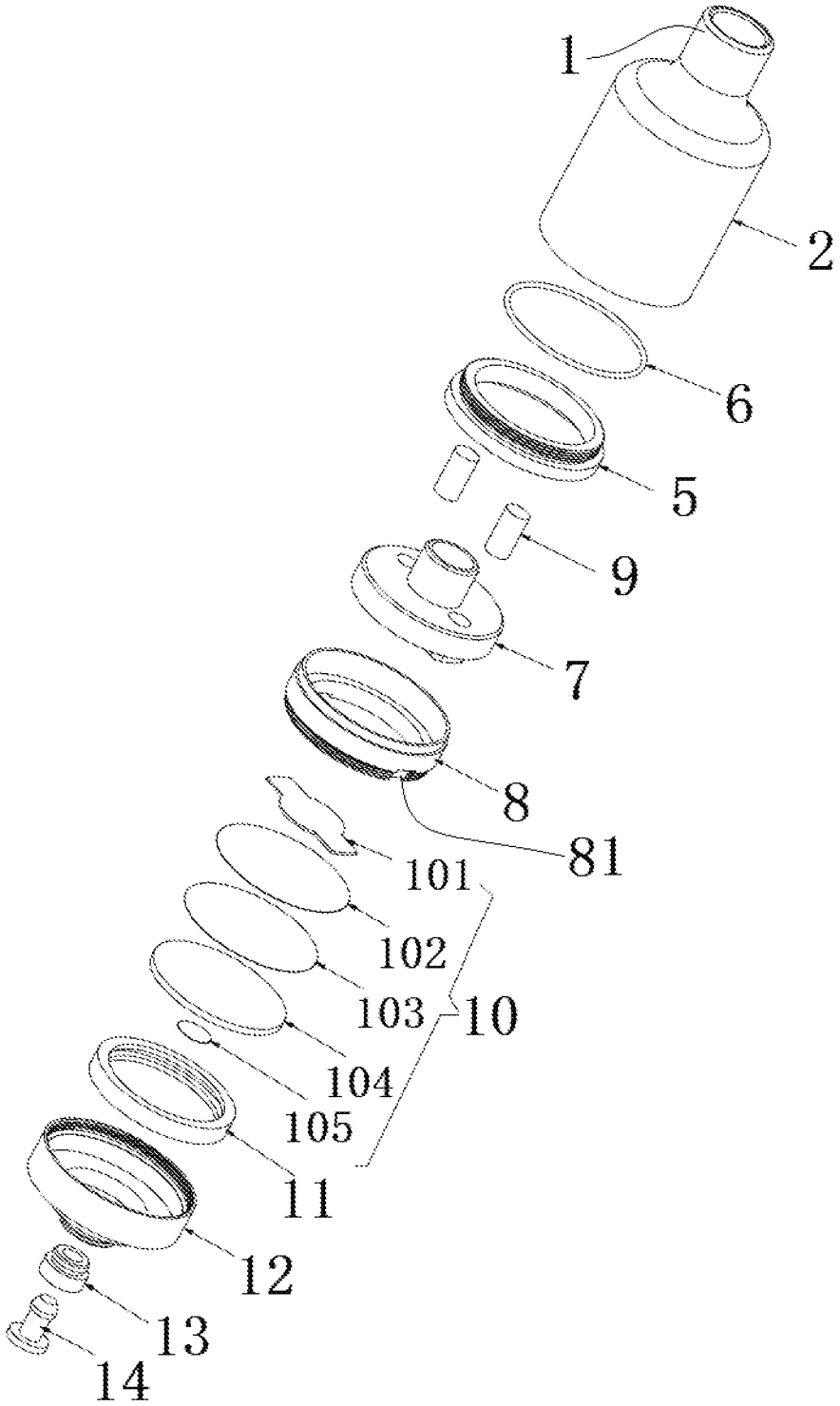
FIG. 3 is an explosive schematic diagram of FIG. 1.

As shown in FIG. 3, a tobacco tar bin is provided in the outer sleeve 2, a tobacco tar guide structure for communicating the tobacco tar bin with the tobacco tar adsorption layer is provided in the tobacco tar guide component 3, so that the tobacco tar in the tobacco tar bin is transferred to the tobacco tar adsorption layer through the tobacco tar guide structure and after the tobacco tar is atomized into tobacco tar smoke by ultrasonic atomization, the tobacco tar smoke flows to the suction nozzle 1. The outer sleeve 2 is in detachable connection with the tobacco tar guide component 3, and the tobacco tar guide component 3 is in detachable connection with the atomization core 4, so that the connections among the outer sleeve, the tobacco tar guide component and the atomization core are detachable connections, which reduces the use cost, facilitates the replacement of damaged components and facilitates the cleaning, and accordingly the user experience is enhanced.

Preferably, the tobacco tar guide component 3 comprises a connector 5 connected with the outer sleeve 2, and a sealing ring 6 is provided between the connector 5 and the outer sleeve 2; a fixing base 8, a silica gel base 7 installed in the fixing base 8, and tobacco tar guide cotton 9 located in the silica gel base 7; a vent hole or a vent groove 81 is formed in the side wall of the fixing base 8.

Preferably, the atomization core 4 comprises a base 12, a silica gel sleeve 11 installed in the base 12; an inner electrode 14 installed at the lower end of the base 12 through an insulation ring 13 and is located between the inner electrode 14 and the base 12; and a piezoelectric ceramic component 10 serving as the ultrasonic atomization piece, the piezoelectric ceramic component 10 is provided in the silica gel sleeve 11, and the lower surface of the piezoelectric ceramic component 10 is in electric contact with the top end of the inner electrode 14.

In the present invention, the tobacco tar adsorption layer and the ultrasonic atomization piece are integrated together, and the total area of the surface of the tobacco tar adsorption layer is smaller than the area of the surface of the ultrasonic atomization piece, that is to say, the tobacco tar adsorption layer is provided on a partial surface of the ultrasonic atomization piece, so that the atomization start speed is high, and the consistency of the supply quantity of each take can be guaranteed, the atomization effect is better, and the working life is prolonged.

According to the ultrasonic atomization piece of the present invention, the tobacco tar adsorption layer and the ultrasonic atomization piece can be integrated together by the package process or the etching process, that is, the tobacco tar adsorption layer can be fixed to the surface of the ultrasonic atomization piece, as long as the tobacco tar adsorption layer is firmer and is unlikely to delaminate.

The ultrasonic atomizer is provided with the ultrasonic atomization piece that can automatically guide the tobacco tar, functions of tobacco tar guide and ultrasonic atomization can be achieved by the propping the porous material layer on the ultrasonic atomization piece against the tobacco tar guide structure, so that the atomizer is simple in structure, convenient to assemble and free of the tobacco tar soaking phenomenon.

The tobacco tar adsorption layer and the ultrasonic atomization piece are integrated together by the assembly method of the package process, and thus the tobacco tar guide performance and the atomization effect of the ultrasonic atomization piece are improved.

The contents set forth in the above-mentioned embodiments should be construed in such a way that these embodiments are merely used for illustrating the present invention more clearly rather than limiting the scope of the present invention, and after reading the present invention, all modifications in various equivalent forms made by those skilled in the art shall be within the scope defined by the claims appended in the present application.

The invention claimed is:

1. An ultrasonic atomization piece, wherein the ultrasonic atomization piece comprises a ceramic substrate which is provided with an upper silver layer on an upper surface of the ceramic substrate and a lower silver layer on a lower surface of the ceramic substrate; the ceramic substrate, the upper silver layer and the lower silver layer form piezoelectric ceramic, and a glass glaze layer for protecting the upper silver layer is provided on an upper surface of the piezoelectric ceramic; and a tobacco tar adsorption layer is provided on an upper surface of the glass glaze layer to form a piezoelectric ceramic component, and the tobacco tar adsorption layer is used for adsorbing, guiding and transferring tobacco tar.

2. The ultrasonic atomization piece of claim 1, wherein the tobacco tar adsorption layer is a ceramic slurry layer.

3. The ultrasonic atomization piece of claim 1, wherein the tobacco tar adsorption layer is a porous material layer.

4. The ultrasonic atomization piece of claim 3, wherein the upper surface of the glass glaze layer is formed into a concavo-convex surface, and the porous material layer is fixed to the concavo-convex surface.

5. The ultrasonic atomization piece of claim 4, wherein the concavo-convex surface and the porous material layer are adhered together by high-temperature glue.

6. The ultrasonic atomization piece of claim 3, wherein the thickness of the porous material layer is 0.1-0.5 mm.

7. The ultrasonic atomization piece of claim 3, wherein the porous material layer is cotton or non-woven fabric.

8. A manufacturing method of the ultrasonic atomization piece of claim 1, wherein the manufacturing method comprises the following steps:

S1, spraying or printing the upper silver layer on the upper surface of the ceramic substrate, and spraying or printing the lower silver layer on the lower surface of the ceramic substrate to form the piezoelectric ceramic;

S2, spraying or printing the glass glaze layer on the surface of the upper silver layer of the piezoelectric ceramic;

S3, spraying or printing a ceramic slurry layer serving as the tobacco tar adsorption layer on the surface of the glass glaze layer of the piezoelectric ceramic to obtain a primary green body of the piezoelectric ceramic component; and S4, heating, sintering and solidifying the primary green body of the piezoelectric ceramic component, and cooling the primary green body of the piezoelectric ceramic component to obtain a finished product of the piezoelectric ceramic component.

9. The manufacturing method of the ultrasonic atomization piece of claim 8, wherein heating, sintering and solidifying temperature of the primary green body of the piezoelectric ceramic component is 600-900° C., the sintering time is 2-18 h, and preferably, the sintering time is 10-14 h.

10. The manufacturing method of the ultrasonic atomization piece of claim 8, wherein after being heated, sintered and solidified, the primary green body of the piezoelectric ceramic component is cooled in a cooling device for 8-25 h to obtain the finished product, and preferably, the cooling time is 12-15 h.

11. A manufacturing method of the ultrasonic atomization piece of claim 1, wherein the manufacturing method comprises the following steps:

S1, spraying or printing the upper silver layer on the upper surface of the ceramic substrate, and spraying or printing the lower silver layer on the lower surface of the ceramic substrate to form the piezoelectric ceramic;

S2, spraying or printing the glass glaze layer on a surface of the upper silver layer of the piezoelectric ceramic;

S3, grinding a surface of the glass glaze layer of the piezoelectric ceramic to form a concavo-convex surface, and then fixing a porous material layer serving as the tobacco tar adsorption layer on the concavo-convex surface of the glass glaze layer to obtain a primary green body of the piezoelectric ceramic component; and S4, drying and solidifying the primary green body of the piezoelectric ceramic component to obtain a finished product of the piezoelectric ceramic component.

12. The manufacturing method of the ultrasonic atomization piece of claim 11, wherein high-temperature glue is coated on the concavo-convex surface of the glass glaze layer, then the porous material layer is adhered on the concavo-convex surface of the glass glaze layer, and finally drying and solidifying treatments are carried out.

13. An ultrasonic atomizer, comprising an outer sleeve with a suction nozzle, a tobacco tar guide component fixed to a lower end of the outer sleeve, and an atomization core fixed to a lower end of the tobacco tar guide component, wherein the ultrasonic atomization piece of claim 1 is installed in the atomization core, and the tobacco tar adsorption layer of the ultrasonic atomization piece is in contact with the tobacco tar guide component.

14. The ultrasonic atomizer of claim 13, wherein a tobacco tar bin is provided in the outer sleeve, a tobacco tar guide structure for communicating the tobacco tar bin with the tobacco tar adsorption layer is provided in the tobacco tar guide component, so that the tobacco tar in the tobacco tar bin is transferred to the tobacco tar adsorption layer by the tobacco tar guide structure, and then after the tobacco tar is atomized into tobacco tar smoke by ultrasonic atomization, the tobacco tar smoke flows to the suction nozzle.

15. The ultrasonic atomizer of claim 13, wherein the outer sleeve is in detachable connection with the tobacco tar guide component, and the tobacco tar guide component is in detachable connection with the atomization core.

16. The ultrasonic atomizer of claim 13, wherein the tobacco tar guide component comprises:

a connector connected with the outer sleeve, and a sealing ring is provided between the connector and the outer sleeve; and a fixing base, a silica gel base installed in the fixing base, and tobacco tar guide cotton located in the silica gel base; and a vent hole or a vent groove is provided in the side wall of the fixing base.

17. The ultrasonic atomizer of claim 13, wherein the atomization core comprises:

a base, a silica gel sleeve installed in the base;

an inner electrode installed at the lower end of the base through an insulation ring; and a piezoelectric ceramic component serving as the ultrasonic atomization piece, the piezoelectric ceramic component is provided in the silica gel sleeve, and the lower surface of the piezoelectric ceramic component is in electric connection with the top end of the inner electrode.

18. An electronic cigarette, wherein the electronic cigarette comprises the ultrasonic atomizer of claim 13.

* * * * *